United States Patent [19]

Yu

[11] Patent Number: 4,781,616

[45] Date of Patent: Nov. 1, 1988

[54] SOCKET ASSEMBLY

[76] Inventor: Alexander K. Yu, 10th Fl., 546, Min Chuan E. Rd., Taipei, Taiwan

[21] Appl. No.: 97,511

[22] Filed: Sep. 15, 1987

[51] Int. Cl.[4] ..... H01R 4/24

[52] U.S. Cl. ..... 439/409

[58] Field of Search ..... 439/395–426

[56] References Cited

U.S. PATENT DOCUMENTS 3,369,213 2/1968 Palmer ..... 439/409

4,529,258 7/1985 Anthony ..... 339/99 L

*Primary Examiner*—Joseph H. McGlynn

*Attorney, Agent, or Firm*—McGlew and Tuttle

[57] ABSTRACT

A novel socket assembly includes: a non-conductive body having an L-shaped recess provided in a middle portion; a pair of differently constructed conducting pieces separately fixed on the non-conductive body; a coupling member formed in an L shape in conformity with the L-shaped recess for making close engagement therewith; and a pair of piercing terminal members symmetrically disposed on a reverse surface of the coupling member in conjunction with the conducting pieces; thereby, an electrical connection can be quickly and conveniently made without requiring any screws.

5 Claims, 4 Drawing Sheets

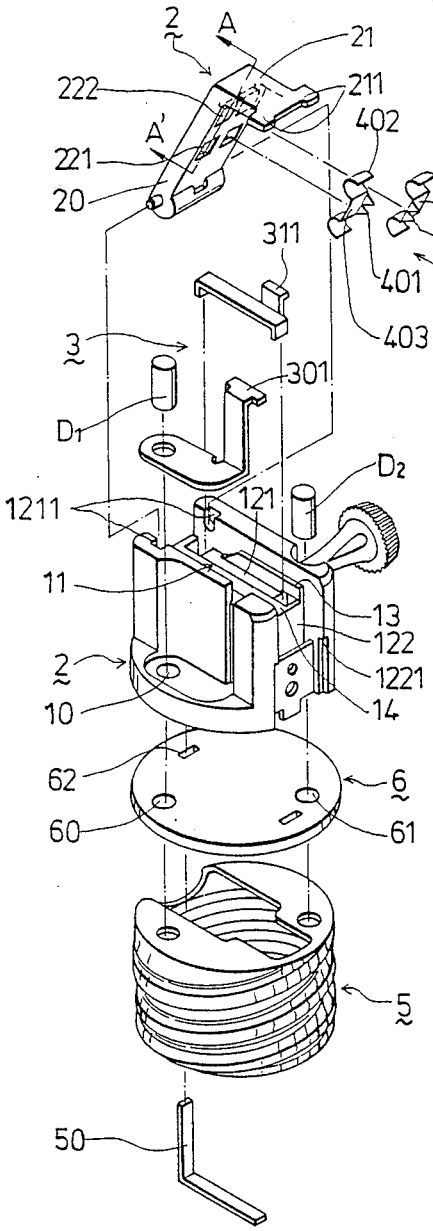
FIG. 2A
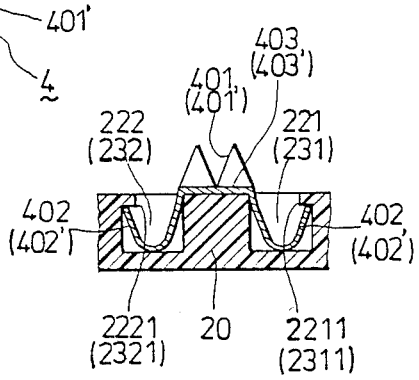
FIG. 2 A-A'

SOCKET ASSEMBLY

BACKGROUND OF THE INVENTION

This invention relates to a socket assembly, and more particularly to a novel socket assembly having piercing terminal means arranged on a reverse side of a coupling means of the socket assembly for effecting quick and convenient wire connection without requiring any screws.

Generally, socket assemblies are classified into two types--a switch control type and non-switch control type. No matter which type the known socket assemblies belong to , all wire terminals thereof are similar to each other. As shown in FIG. 1, the non-switch control type of a known socket assembly is usually combined of a body A, a screwshell B and a pair of conductive pieces C1 and C2. The conductive pieces C1 and C2 are respectively fastened in the screwshell B through a plurality of metal pins D, wherein the conductive piece C1 is kept in contact with the screwshell B, serving as a neutral terminal while the conductive piece C2 is positioned on the bottom side of the body A with its contact located in the screwshell, seving as a "hot" terminal thereat. Electrical lines F1 and F2 each having a stripped end thereof are respectively connected to the conductive pieces C1 and C2 through a pair of screws E1 and E2.

As can be seen in FIG. 1, the insulation of the electrical cords F1 and F2 have to be stripped off at each end with the conductors of the electrical cords being hooked around the screws E1 and E2 before making electrical connections with the conductive pieces C1 and C2. To successfully complete the detailed procedure of making this electrical connection, a skilled worker is usually required.

In order to simplify the above-mentioned procedure, a kind of socket assembly with piercing wire terminals has been developed. A typical structure of this socket assembly is shown in U.S. Pat. No. 4,529,258 issued to W. H. Anthony. With the improvement made by Anthony, there is no need to strip off the insulation of the electrical cords and to hook up the conductors thereof. However, the screw connection procedure for that type of socket assembly is still required for securing the cover to the terminal end of the body.

SUMMARY OF THE INVENTION

It is accordingly a primary object of this invention to provide a novel socket assembly having piercing terminal means arranged on a reverse side of a coupling means so as to overcome the problem associated with the prior art.

This and other objects of the present invention are achieved by providing a novel socket assembly which includes: a non-conductive body integrally formed with an L-shaped recess in the middle, a plurality of coupling guide openings at one end and a positioning shoulder at the other end with at least two different levels defined therein; a coupling means having a coupling flange provided at one end in conjunction with the coupling guide openings, and a positioning flange at the other end in line with the positioning shoulder; a piercing terminal means disposed on a reverse side of the coupling means; a negative and a positive conducting piece, each having a contact at one end, separately fixed on the non-conductive body in conjunction with the piercing terminal means; and a screwshell having a positive conducting member disposed therein fixed on the bottom side of the non-conductive body through a plurality of riveting pins; thereby, electrical cord can be quickly and conveniently connected without requiring any screws.

This invention resides in a structure of the coupling means having the piercing terminal means provided on a reverse side thereof in conjunction with the conducting pieces disposed in the non-conductive body so that, by pressing the coupling means over the non-conductive body, the serrations of the piercing terminal means will be inserted into the electrical cord placed in the recess of the non-conductive body so as to accomplish the electrical connection therewith.

This invention also resides in an arrangement of the coupling means and the L-shaped recess of the non-conductive body, wherein the coupling means is provided with a coupling flange and a positioning flange while the L-shaped recess is formed with a pair of coupling guide openings and a positioning shoulder so that the coupling means and the non-conductive body can be firmly engaged with each other without requiring any screw.

Other advantages and salient features of this invention will become clear from the following detailed description when read in conjunction with the accompanying drawings.

BRIEF DESCRIPTION OF THE DRAWINGS

FIG. 2A is an explosive and perspective view of a preferred embodiment of a socket assembly according to this invention;

FIG. 2A-A' is a sectional view taken along the line A-A' of FIG. 2A;

DETAILED DESCRIPTION OF THE PREFERRED EMBODIMENT

Figure 1:
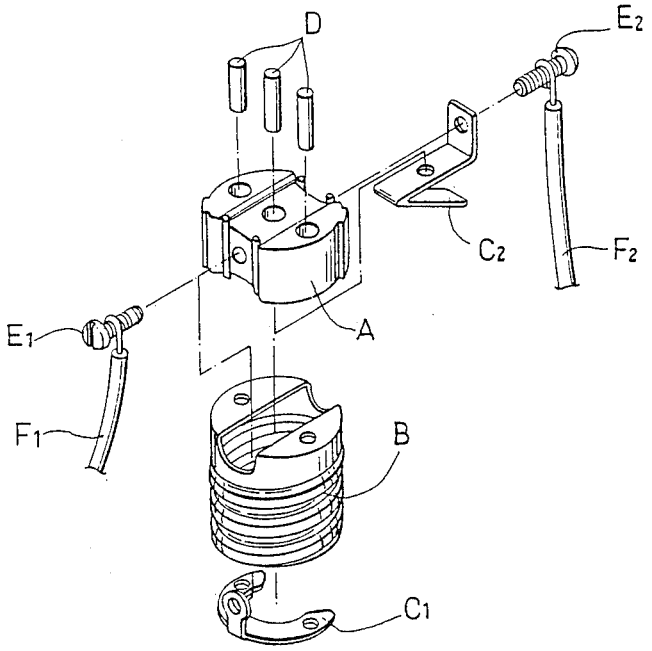
PRIOR ART FIG. 1
FIG. 1 is an explosive and perspective view of a known switchless socket assembly.

Referring to FIGS. 2A, 2A-A' and 3, the preferred embodiment of a novel socket assembly according to this invention includes in combination a non-conductive body 1, a coupling means 2, conducting means 3, piercing terminal means 4, a screwshell 5 and an insulating plate 6.

The non-conductive body 1 includes: a plurality of through-pin holes 10, 11 provided in a lower portion; an L-shaped recess 12 with a horizontal part 121 and a vertical part 122 formed in a central portion; a pair of coupling guide openings 1211 located at a rar open end of the horizontal part 121; a positioning shoulder 1221, which is wider than the vertical part 122, formed at an end of the vertical part 122; and two different levels 13 and 14 formed in the horizontal part 121 of the L-shaped recess 12.

The conducting means 3 includes two differently constructed pieces—a negative conducting piece 30 and a positive conducting piece 31 each having an extended contact 301, 311 formed thereto. The negative conducting piece 30 is fixed on one side of non-conductive body 1 in pin hole 10 through a first riveting pin D1 with the extended contact 301 positioned on the level 14 while the positive conducting piece 31 is inserted in the horizontal part 121 with the extended contact 311 located on the level 13 as shown in FIG. 3.

The coupling means 2 is formed in an L-shape with a horizontal portion 20 and a vertical portion 21 respectively corresponding to the horizontal part 121 and the vertical part 122 of the L-shaped recess 12 of the non-conductive body 1 for effecting close engagement with each other. The horizontal portion 20 includes: a coupling flange 200 at a rear end with a pivot pin 201 provided at the opposing sides of the coupling flange 200 for being pivotally disposed in the guide openings 1211 of the L-shaped recess 12; and a first pair of slots 221, 222 and a second pair of slots 231, 232 symmetrically provided at the opposing sides on the reverse surface, and each one of the slots being formed with a flange 2211, 2221, 2311, 2321 along an upper edge of each slot for positioning purpose. The vertical portion 21 includes a positioning flange 211 formed at a lower end, corresponding to the positioning shoulder 1221 of the L-shaped recess 12 so as to effect close engagement therewith when the coupling means 2 is pressed against the non-conductive body 1.

The piercing terminal means 4 having a pair of serrated conductive member 40 and 40' formed in an arcuate shape, each having two serrations 401 and 401' in a pair located at a middle level 403, 403' and a curved portion 402, 402' at the opposing sides, is disposed on the reverse surface of the coupling means 2 with the curved portions 402, 402' being respectively positioned in the slots 221, 231, 222 and 232 under the flanges 2211, 2221, 2311 and 2321, as shown in FIGS. 2 A-A' and 3, for securing the piercing terminal meass 4 therein, and the middle levels 403, 403' will be respectively connected to the contacts 301 and 311 of the conducting means 3 when the coupling means 2 is closely engaged with the L-shaped recess 12 of the non-conductive body 1.

Figure 2B:
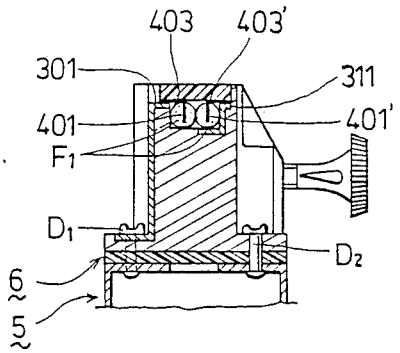
FIG. 2B is a partial sectional view of the preferred embodiment shown in FIG. 2A.
Figure 3:
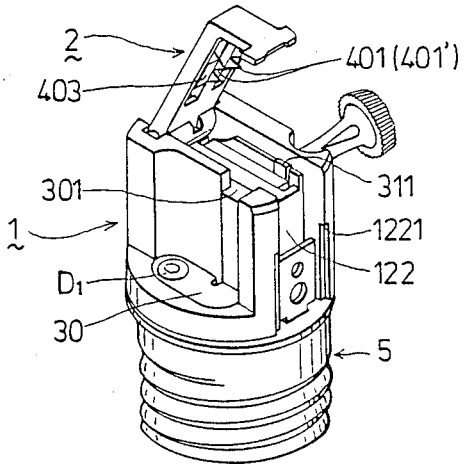
FIG. 3 is an assembled perspective view of the preferred embodiment of FIG. 2A.

The screwshell 5 with a positive terminal member 50 disposed therein is, as usual, fastened to the bottom side of the non-conductive body 1 by the riveting pins D1 and D2, as shown in FIG. 2B, through the pin holes 60 and 61 of the insulating plate 6 which is positioned between body 1 and screwshell 5, wherein the positive terminal member 50 is kept in contact with the positive conducting piece 31 through an opening 62 of the insulating plate 6 while the negative conducting piece 30 is connected to the screwshell 5 through the pivot pin D1 as shown in FIG. 3.

Figure 4A:
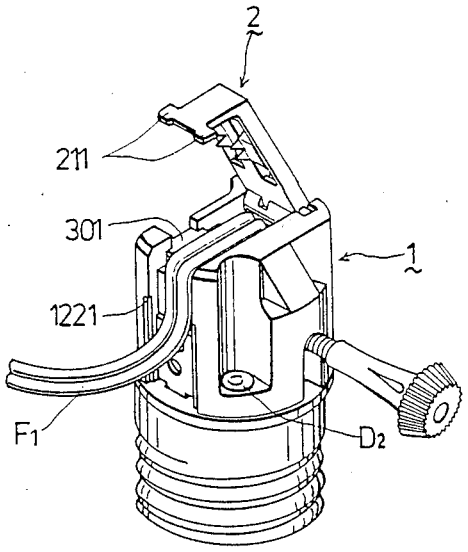
FIG. 4A is a perspective view of the preferred embodiment with an electrical cord being positioned for making the electrical connection therewith.
Figure 4B:
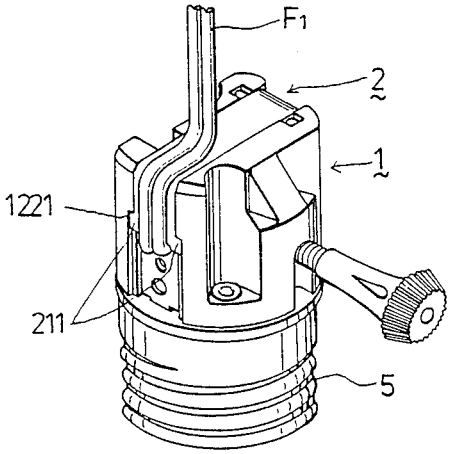
FIG. 4B is an illustrative view showing a connected condition of the electrical cord in the preferred embodiment according to this invention.

Referring to FIGS. 2B, 4A and 4B, operations of the preferred embodiment are as follows:

As shown in FIG. 4A, having electrical cord F1 placed in the L-shaped recess 12, closing down the coupling means 2 and pressing it against the nonconductive body 1, the serrations 401 and 401' of both conductive members 40 and 40' will be separately pierced into the electrical cord F1, as shown in FIG. 2B, in making electrical contact with respective conductors of the electrical cord F1 while the curved portions 402 and 402' are also separately engaged with the negative conducting piece 30 and the positive conducting piece 31 so that electrical connection is easily and quickly accomplished accordingly. In the meantime, the positioning flange 211 of the coupling means 2 is also tightly engaged with the positioning shoulder 1221 of the L-shaped recess 12 of the non-conductive body 1, as shown in FIG. 4B, and the electrical cord F1 can be conveniently curved along the outer surface of the L-shaped coupling means 2 for proper installation therewith (It shall be appreciated that since the switching arrangement in the non-conductive body 1 is well known to those skilled in the art, explanation and illustration are hereby omitted for clarity).

While a preferred embodiment has been illustrated and described, it will become apparent that many changes may be made in the general construction and arrangement of the invention without departing from the scope thereof, and it is therefore desired that the invention be not limited to the exact disclosure but only to the extent of the appended claims.

What is claimed is:

1. A socket assembly having a screwshell provided for holding an electric lamp bulb, an isolating plate for being positioned on top of the screwshell, and a positive terminal member disposed in the screwshell with one end extending through the top thereof, comprising:

a non-conductive body with an L-shaped recess in a middle portion fixedly connected to the screwshell at a lower end through a plurality of riveting pins;

conducting means disposed on said non-conductive body in connection with the screwshell and the positive terminal member for effecting electrical connections therewith;

a coupling means, formed in an L shape with a horizontal portion and a vertical portion in conjunction with said L-shape recess, pivotally connected to said non-conductive body for being closely engaged withh said L-shaped recess; and piercing terminal means separately disposed on a reverse surface of the horizontal portion of said coupling means in conjunction with said conducting means for being respectively inserted into the insulation of an electrical cord and making electrical connections with said conducting means; so that, by pressing said coupling means against said non-conductive body along said L-shaped recess, an electrical connection can be quickly and conveniently made through the close engagement of said coupling means and said non-conductive body without requiring any screws.

2. A socket assembly as claimed in claim 1 wherein said L-shaped recess of said non-conductive body comprises:

a horizontal part having a plurality of coupling guide openings formed at a rear end for being pivotally engaged with said coupling means, and at least two different levels located at each side for respectively receiving the extended contacts of said conducting means; and a vertical part with a positioning shoulder formed at a lower end for being engaged with the positioning flange of said coupling means.

3. A socket assembly as claimed in claim 1 wherein said conducting means comprises a pair of differently constructed conducting pieces respectively fixed on said non-conductive body serving as a negative conducting piece and a positive conducting piece thereat, and each conducting piece having an extended contact formed at one end for being separately positioned in the different levels of said L-shaped recess, 4. A socket assembly as claimed in claim 1 wherein said coupling means further comprises:

a first pair of slots each having a flange formed along an upper edge thereof provided at one side on the reverse surface of said horizontal portion for positioning one serrated conductive member of said piercing means; and a second pair of slots symmetrically provided at another side on the reverse surface of said horizontal portion in conjunction with said first pair of slots, and each one of said second pair of slots having a flange formed along an upper edge thereof for positioning another serrated conductive member of said piercing means.

5. A socket assembly as claimed in claim 1 wherein said piercing means comprises a pair of serrated conductive members, each serrated conductive member being formed in an arcuate shape with a pair of serrations located at a middle level and a curved portion at each side one opposite the other for being symmetrically positioned in said pairs of slots with said curved portions respectively located on said pairs of slots in conjunction with said conducting means disposed on said non-conductive body.

* * * * *